US009611654B2

(12) United States Patent
Dao et al.

(10) Patent No.: US 9,611,654 B2
(45) **Date of Patent: *Apr. 4, 2017**

(54) FLOOR PANEL AND FLOATING FLOOR SYSTEM INCORPORATING THE SAME

(71) Applicant: ARMSTRONG WORLD INDUSTRIES, INC., Lancaster, PA (US)

(72) Inventors: Dung V. Dao, Lititz, PA (US); Richard H. Balmer, Rocky Face, GA (US)

(73) Assignee: AFI Licensing LLC, Lancaster, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/615,944

(22) Filed: Feb. 6, 2015

(65) Prior Publication Data

US 2015/0152646 A1 Jun. 4, 2015

Related U.S. Application Data

(63) Continuation of application No. 13/214,318, filed on Aug. 22, 2011, now Pat. No. 8,950,147.

(51) Int. Cl.

| | |
|---|---|
| ***E04F 15/02*** | (2006.01) |
| ***E04F 15/10*** | (2006.01) |
| ***E04F 15/18*** | (2006.01) |

(52) U.S. Cl.

CPC ..... *E04F 15/02* (2013.01); *E04F 15/105* (2013.01); *E04F 15/18* (2013.01); *E04F 15/181* (2013.01);

(Continued)

(58) Field of Classification Search

CPC ... E04F 15/02; E04F 2201/0517; E04F 15/04; E04F 2203/06; E04F 15/02138;

(Continued)

(56) References Cited

U.S. PATENT DOCUMENTS

| | | | |
|---|---|---|---|
| 2,737,693 | A | 3/1956 | Robbins |
| 2,914,815 | A | 12/1959 | Alexander |

(Continued)

FOREIGN PATENT DOCUMENTS

| | | | |
|---|---|---|---|
| AU | 2006201915 | B1 | 5/2007 |
| AU | 2006252200 | A1 | 7/2007 |

(Continued)

OTHER PUBLICATIONS

Chinese Search Report for corresponding CN Application No. 2012800406071, mailed Jun. 3, 2015.

(Continued)

*Primary Examiner* — James Ference

(57) ABSTRACT

A floor panel and a floating floor system include a top surface and a bottom surface. The top surface has a visible decorative pattern and the bottom surface has a recess which extends about the periphery of the bottom surface. The recess has a recess surface. The floor panel includes a joining member with a top surface and a bottom surface. The top surface of the joining member is adhered to the recess surface of the recess. The bottom surface of the joining member and the bottom surface of the floor panel are essentially flush which each other. The use of the joining member does not create any imprints on the top surface of the floor panel.

19 Claims, 3 Drawing Sheets

(52) U.S. Cl.
CPC ... *E04F 2201/0511* (2013.01); *E04F 2201/07* (2013.01)

(58) Field of Classification Search
CPC ..... E04F 2201/0115; E04F 2201/07; E04F 15/02005; E04F 15/10; E04F 2201/0138; E04F 2201/0153; Y10T 428/23979; Y10T 428/198; Y10T 428/24777
USPC ..... 52/309.9, 384, 385, 386, 387, 177, 545, 52/591.4, 574, 588.1, 582.1, 582.2, 52/506.05, 391, 578, 592.1, 586.1, 586.2, 52/585.1, 589.1, 590.1, 590.2, 590.3
See application file for complete search history.

(56) References Cited

U.S. PATENT DOCUMENTS 3,270,473 A 9/1966 Smith
3,731,445 A 5/1973 Hoffmann et al.
3,866,267 A 2/1975 Poletti
3,902,293 A 9/1975 Witt et al.
3,988,187 A 10/1976 Witt et al.
4,156,054 A 5/1979 Gurewitsch
4,169,688 A 10/1979 Toshio
4,242,390 A 12/1980 Nemeth
4,489,115 A 12/1984 Layman et al.
4,612,075 A 9/1986 Waugh
4,649,069 A 3/1987 Tone
4,766,022 A 8/1988 Tone
4,804,569 A 2/1989 Arisawa
4,920,720 A 5/1990 Labianca
5,045,389 A 9/1991 Campagna
5,283,102 A 2/1994 Sweet et al.
5,316,861 A * 5/1994 Marchal ..... B29C 43/30 156/196
5,366,775 A 11/1994 Kao
5,382,462 A 1/1995 Pacione
5,750,227 A 5/1998 Adams
5,894,700 A 4/1999 Sweet
5,950,389 A 9/1999 Porter
6,189,279 B1 2/2001 Fiechtl
6,298,624 B1 10/2001 Pacione
6,306,477 B1 10/2001 Pacione
6,395,362 B1 5/2002 Pacione
6,449,918 B1 * 9/2002 Nelson ..... E04F 15/04 52/570
6,453,632 B1 9/2002 Huang
6,460,303 B1 10/2002 Pacione
6,536,178 B1 * 3/2003 Pålsson et al. ..... B44C 3/123 52/392
6,647,684 B1 11/2003 Gank
6,694,691 B2 2/2004 Ku
6,751,917 B2 6/2004 Mao
6,763,643 B1 7/2004 Maartensson
6,786,019 B2 * 9/2004 Thiers ..... B44C 1/24 52/586.1
6,797,353 B1 9/2004 Pacione
6,802,167 B2 10/2004 Pacione
6,920,732 B2 7/2005 Martensson
6,988,343 B2 1/2006 Gleeson et al.
6,990,777 B2 1/2006 Poliacek et al.
7,021,018 B2 4/2006 Peng
7,121,059 B2 10/2006 Pervan
7,155,871 B1 1/2007 Stone et al.
7,164,843 B2 1/2007 Wada
7,185,465 B2 3/2007 Pacione
7,185,473 B2 3/2007 Pacione
7,275,350 B2 10/2007 Pervan et al.
7,322,159 B2 1/2008 Stone et al.
7,383,663 B2 6/2008 Pacione
7,412,806 B2 8/2008 Pacione et al.
7,458,191 B2 12/2008 Stone
8,006,458 B1 8/2011 Olofsson et al.
2003/0009972 A1 * 1/2003 Pervan ..... B23P 11/00 52/582.1
2003/0024199 A1 * 2/2003 Pervan ..... E04F 15/02005 52/589.1
2003/0084636 A1 * 5/2003 Pervan ..... E04F 15/04 52/592.1
2003/0097808 A1 * 5/2003 Sabatini ..... E04F 15/02405 52/386
2003/0110720 A1 * 6/2003 Berard ..... A47G 27/0475 52/263
2003/0126817 A1 * 7/2003 Gleeson ..... A61L 15/58 52/460
2003/0126822 A1 7/2003 Gleeson
2003/0129362 A1 * 7/2003 Simon ..... B29C 44/06 428/172
2003/0131550 A1 7/2003 Cole et al.
2003/0136072 A1 7/2003 Peng
2003/0177728 A1 * 9/2003 Ku ..... E01O 5/223 52/403.1
2003/0180091 A1 * 9/2003 Stridsman ..... E04F 15/02 404/41
2004/0172904 A1 9/2004 Martensson
2004/0211139 A1 10/2004 Peng
2004/0244325 A1 * 12/2004 Nelson ..... E04F 15/04 52/582.1
2005/0005558 A1 * 1/2005 Bolduc ..... E04F 15/04 52/582.1
2005/0055976 A1 3/2005 Pacione
2005/0076606 A1 * 4/2005 Curtis ..... E04F 15/02005 52/741.1
2006/0059825 A1 * 3/2006 Wiercinski ..... C09J 5/00 52/506.01
2006/0159891 A1 * 7/2006 Viet ..... B32B 27/12 428/172
2006/0185303 A1 * 8/2006 Pacione ..... A47G 27/0468 52/582.1
2006/0240247 A1 * 10/2006 Haller ..... A44C 9/0053 428/335
2006/0269713 A1 * 11/2006 Zuege ..... B32B 7/12 428/40.1
2007/0079572 A1 4/2007 Pacione
2007/0163194 A1 * 7/2007 Stone ..... B32B 27/08 52/309.8
2007/0204428 A1 9/2007 Pacione
2007/0204556 A1 * 9/2007 Pacione ..... A47G 27/0293 52/745.21
2008/0172968 A1 7/2008 Pacione
2008/0289277 A1 * 11/2008 Stone ..... E04F 15/10 52/302.1
2009/0019808 A1 * 1/2009 Palsson ..... E04F 15/02 52/588.1
2009/0031657 A1 2/2009 Pacione
2009/0038251 A1 2/2009 Pacione
2009/0094919 A1 * 4/2009 Scott ..... A47G 27/0243 52/403.1
2009/0107076 A1 * 4/2009 Kim ..... E04F 15/02 52/582.1
2010/0205889 A1 * 8/2010 Anderson ..... E04F 15/02 52/588.1
2010/0247834 A1 * 9/2010 Balmer ..... E04F 15/107 428/41.8
2010/0251641 A1 * 10/2010 Gallagher ..... E04F 15/18 52/177
2011/0042003 A1 * 2/2011 Balmer ..... B32B 37/1284 156/325
2011/0061328 A1 * 3/2011 Sandy ..... A47G 27/0481 52/582.1
2012/0042602 A1 * 2/2012 Buckwalter ..... C09J 7/0217 52/741.1
2012/0096798 A1 * 4/2012 Ko ..... E04F 15/02 52/578

FOREIGN PATENT DOCUMENTS

CA 2260073 A 1/1998
CA 2513973 A1 8/2004
CA 2568978 A1 2/2007
CN 2707886 Y 7/2005

(56) References Cited

FOREIGN PATENT DOCUMENTS

| | | | |
|---|---|---|---|
| CN | 20707886 | | 7/2005 |
| JP | 2007182750 | A | 7/2007 |
| JP | 2007182751 | A | 7/2007 |
| TW | M399887 | U | 3/2011 |
| WO | 2009/036508 | A1 | 3/2009 |

OTHER PUBLICATIONS

International Search Report for corresponding International Application No. PCT/US2012/50304, Filed Aug. 10, 2012.

* cited by examiner

FLOOR PANEL AND FLOATING FLOOR SYSTEM INCORPORATING THE SAME

CROSS-REFERENCE TO RELATED PATENT APPLICATIONS

The present application is a continuation of U.S. Non-provisional patent application Ser. No. 13/214,318, filed Aug. 22, 2011, to be issued as U.S. Pat. No. 8,950,147, the entirety of which is hereby incorporated by reference.

FIELD OF THE INVENTION

The present invention relates to a floor panel, wherein the floor panel has a joining member adhered to the floor panel in an offset relationship, and in particular, to a floor panel in which the bottom surface of the joining member and the bottom surface of the floor panel are essentially flush which each other.

BACKGROUND OF THE INVENTION

Floor panels for use in floating floor systems typically comprise a top layer and a bottom layer adhered together in an offset relationship such that a substantially L-shaped marginal end portion of a top surface of the bottom layer and a substantially L-shaped marginal end portion of a bottom surface of the top layer are exposed. The top layer typically comprises at least one mix layer, a print film, a wear layer, and a top coat. The bottom layer typically comprises at least one mix layer. The bottom layer has a thickness about equal to or greater than the top layer. A ratio of a thickness of the top layer to a thickness of the bottom layer is typically in the range of about 2 or less. For example, the SURFACE SOURCE product sold by Lowe's Home Centers, Inc. has a top layer with a thickness of about 64 mils (about 1.63 millimeters), and a bottom layer with a thickness of about 61 mils (about 1.55 millimeters). Thus, the ratio of the thickness of the top layer to the bottom layer is about 1.05 (64 mils/61 mils=1.05).

In order to assemble the floating floor system, at least one of the marginal end portions of each of the floor panels is provided with an adhesive. The marginal end portion provided with the adhesive is engaged with the marginal end portion of an adjacent floor panel to form the floating floor system. The floor panels may be formed, for example, such that when the floating floor system is assembled on a sub-floor ends of the top layers of the adjacent floor panels substantially abut, while ends of the bottom layers of the adjacent floor panels are spaced apart a desired distance so that a gap is formed there between. Alternatively, the floor panels may be formed, for example, such that when the floating floor system is assembled on the sub-floor the ends of the top layers of the adjacent floor panels substantially abut and the ends of the bottom layers of the adjacent floor panels substantially abut.

Because the thickness of the bottom layer is significantly large (about 98 mils (about 2.5 millimeters)), when the floor panels are assembled such that a gap is formed between the ends of the bottom layers of the adjacent floor panels, the gap can telescope through the floor panels thereby significantly altering the aesthetic and structural characteristics of the top layer. For example, the gaps may cause deformation at a top surface of the top layer. Alternatively, when the floor panels are assembled such that the ends of the bottom layers of the adjacent floor panels substantially abut, unwanted gaps or overlapping can occur between the ends of the top layers due to deviations in the size of the marginal end portions and/or errors occurring during installation. These unwanted gaps or overlaps can additionally telescope through the floor panel thereby also significantly altering the aesthetic and structural characteristics of the top layer.

Additionally, the marginal end portions of the top layer of a first row of the floor panels, which are typically positioned adjacent a wall, remain unsupported when the floating floor system is assembled, because the marginal end portions of the top layer of the first row of the floor panels will not engage with an adjacent floor panel. Thus, because the thickness of the bottom layer is significantly large, the gap occurring between the sub-floor and the marginal end portion of the top layer will also negatively impact the aesthetic and structural characteristics of the top layer. For example, deformation at the top surface of the top layer can occur. Also, because the bottom layer and the top layer comprise mix layers, which contain fillers, the bottom layer and the top layer are prone to absorb moisture thereby further affecting the aesthetic and structural characteristics of the floor panels. This is particularly problematic, since the bottom layer is installed directly on a sub-floor.

Still further, because the bottom layer has a thickness greater than the top layer, when the floor panels are stacked, for example, during shipping, a space exists between the marginal end portions of the top layer of the adjacent flooring panels equal to the thickness of the bottom layer. Thus, during shipping, the unsupported marginal end portions of the top layer are prone to bend and/or curl an amount equal to the thickness of the bottom layer. Because of the structural characteristics of the top layer and the "vinyl memory" of the panels, these bends and/or curls remain in the marginal end portions of the top layer during installation and can thereby significantly alter the aesthetic and structural characteristics of the floor panel. For example, deformation can occur at the top surface of the top layer and/or the bond strength between the marginal end portions of the adjacent floor panels could be negatively affected.

In an attempt to provide better visuals for the flooring system, co-pending U.S. patent application Ser. No. 12/412,419 discloses a floor panel and a floating floor system incorporating the floor panel include a floor panel having a top layer and a bottom layer. The top layer has a top surface and a bottom surface. The top surface has a visible decorative pattern. The bottom layer has a top surface and a bottom surface. The top surface of the bottom layer is adhered to the bottom surface of the top layer such that the bottom layer is offset from the top layer in a direction of length and width and a marginal end portion of the top surface of the bottom layer and a marginal end portion of the bottom surface of the top layer is exposed. At least one of the marginal end portions has an adhesive, and a ratio of a thickness of the top layer to a thickness of the bottom layer is about 5 or greater. Because the thickness of the bottom layer of the floor panels is significantly less than the thickness of the top layer, when the adjacent floor panels are engaged, any unwanted gaps or overlapping that may occur between the first and second ends of the bottom layers of the adjacent floor panels due to deviations in the size of the marginal end portions and/or errors occurring during installation will minimize the aesthetic and/or structural characteristics of the top layer. However, this solution requires a bottom layer that almost completely covers a bottom side of the top layer with a bottom layer of rigid vinyl PVC film or some vinyl composite material of certain thickness to create the ship lap structure. This demands a significant amount of back material as well as adhesive to attach the bottom layer to the top layer. In addition, most of the liner use on the bottom layer must be stripped off and thrown away during the assembly process. The assembly of such large bottom layer onto the top layer is difficult and labor intensive and the use of the rigid bottom layer, which is harder than the top layer itself, may cause the offset lines from the bottom layer to transfer visual imprint defects to the top layer.

In view of the foregoing, there still remains a need to develop a floor panel that overcomes the above-described problems. Additionally, there still remains a need to simplify the manufacturing process for such floor panels and reduce the expense associated therewith.

SUMMARY OF THE INVENTION

An exemplary embodiment of a floor panel includes a top surface and a bottom surface. The top surface has a visible decorative pattern and the bottom surface has a recess which extends about the periphery of the bottom surface. The recess has a recess surface. The floor panel includes a joining member with a top surface and a bottom surface. The top surface of the joining member is adhered to the recess surface of the recess. The bottom surface of the joining member and the bottom surface of the floor panel are essentially flush which each other. The use of the joining member does not create any imprints on the top surface of the floor panel.

An exemplary embodiment of a floor panel for use in a floating flooring system has a top surface and a bottom surface. The top surface has a visible decorative pattern and the bottom surface has recesses which extend about the periphery of the bottom surface. The recesses have recess surfaces with recess thicknesses which are substantially less than a thickness of the floor panel. The floor panel includes joining members with top surfaces and bottom surfaces. The joining members are positioned in the recesses with the top surfaces of the joining members being adhered to the recess surfaces of the recesses by an adhesive. The thickness of each recess is essentially equivalent to the thickness of the respective joining member and adhesive provided therein. The bottom surfaces of the joining members and the bottom surface of the floor panel are essentially flush which each other such that the use of the joining members does not create any imprints on the top surface of the floor panel.

An exemplary embodiment of a floating floor system includes at least two adjacent floor panels. Each of the floor panels has a top surface and a bottom surface. The bottom surface has recesses which extend about the periphery of the bottom surface. The recesses having recess surfaces and recess thicknesses which are substantially less than a thickness of the floor panel. Joining members of the floor panels are positioned in the recesses. The joining members have top surfaces and bottom surfaces, with the top surfaces of the joining members being adhered to the recess surfaces of the recesses by an adhesive. The thickness of each recess being essentially equivalent to the thickness of the respective joining member and adhesive provided therein. The bottom surfaces of the joining members and the bottom surface of the floor panel being essentially flush which each other. The joining members of one respective floor panel are offset from the floor panel to expose marginal portions of the top surfaces of the offset joining members. Respective recesses of a second adjacent floor panel have exposed recess surfaces. At least one of the exposed marginal portions or the exposed recess surfaces has an adhesive. The exposed marginal end portions of the joining members of one respective floor panel are adhered to the exposed recess surfaces of the recesses of the second adjacent floor panel.

Other features and advantages of the present invention will be apparent from the following more detailed description of the exemplary embodiment, taken in conjunction with the accompanying drawings which illustrate, by way of example, the principles of the invention.

DETAILED DESCRIPTION OF THE INVENTION

In the following detailed description, numerous specific details are set forth in order to provide a thorough understanding of various embodiments. However, those skilled in the art will understand that the embodiments may be practiced without these specific details, that the embodiments are not limited to the depicted embodiments, and that the embodiments may be practiced in a variety of alternative embodiments. In other instances, well known methods, procedures, and components have not been described in detail.

Further, various operations may be described as multiple discrete steps performed in a manner that is helpful for understanding the embodiments. However, the order of description should not be construed as to imply that these operations need be performed in the order they are presented, or that they are even order-dependent. Moreover, repeated usage of the phrase "in an embodiment" does not necessarily refer to the same embodiment, although it may. Lastly, the terms "comprising," "including," "having," and the like, as used in the present application, are intended to be synonymous unless otherwise indicated.

Figure 1:
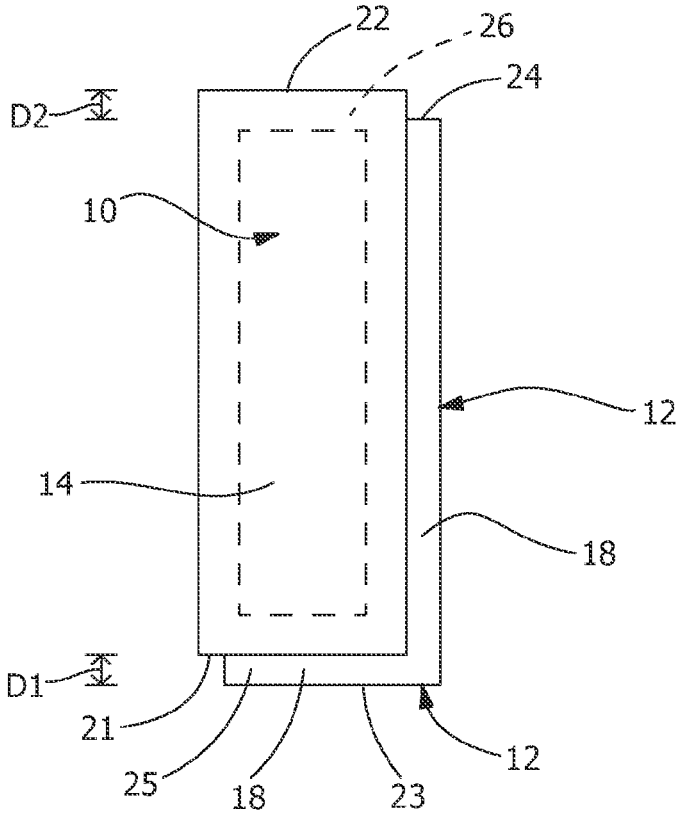
FIG. 1 is a top view of an exemplary floor panel with exemplary joining members attached thereto.

FIGS. 1-5 show a floating flooring system 2 (FIG. 2) according to a first exemplary embodiment of the invention. The flooring system 2 has a floor panel 10 and at least one backing or joining member 12. In addition at least one release member 13 (FIG. 3) may be provided. As shown in FIG. 1, the floor panel 10 may be formed, for example, from a substantially flexible sheet material, such as plastic, vinyl, polyvinyl chloride, polyester, or combinations thereof.

The floor panel 10 has a top surface 14 with a visible decorative pattern and a bottom surface 15. In the illustrated exemplary embodiment, the floor panel 10 comprises at least one layer 80 selected from a mix layer, a print film provided with the visible decorative pattern, a wear layer, and a top coat, respectively. It will be appreciated by those skilled in the art that although the floor panel 10 is shown and described herein as comprising multiple layers that the floor panel 10 may alternatively comprise a single layer. Additionally, the types of layers constituting the floor panel 10 and the visible decorative pattern could be varied depending on the desired characteristics of the floor panel 10.

Figure 3:
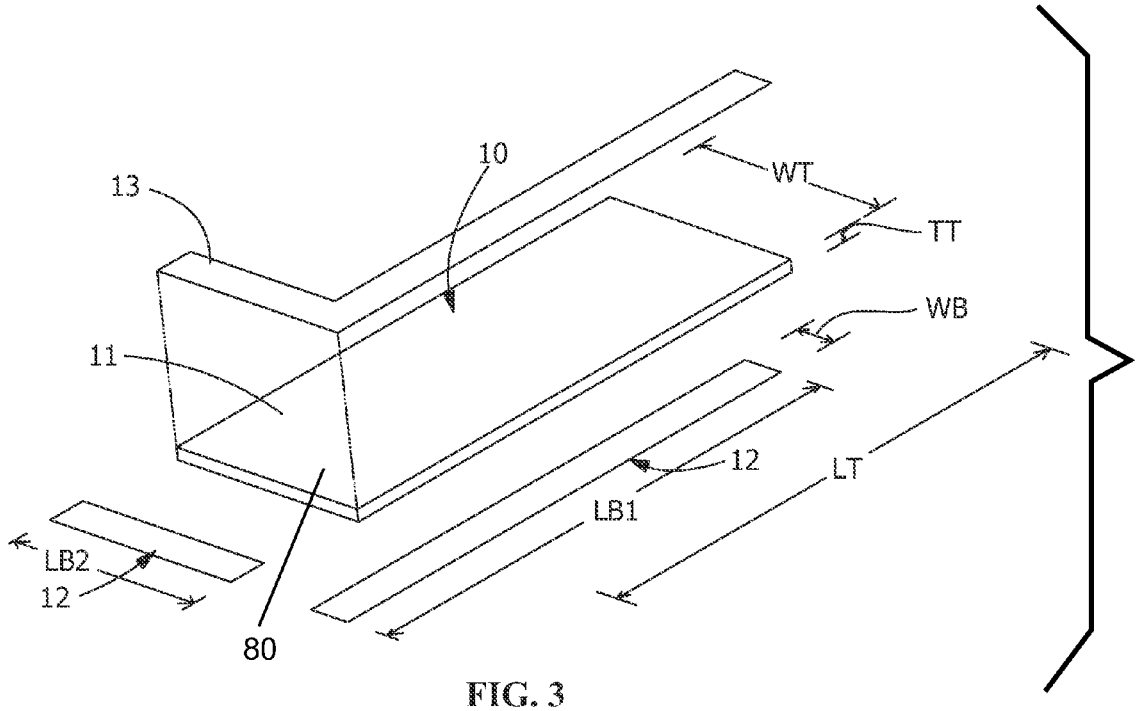
FIG. 3 is a perspective view of the exemplary floor panel with the exemplary joining members and an exemplary release member exploded therefrom.

As shown in FIG. 3, the floor panel 10 has a thickness TT of about 20-200 mils (about 0.508-5.08 millimeters), preferably about 60-180 mils (about 1.524-4.572 millimeters), and more preferably about 80-150 mils (about 2.032-3.810 millimeters). In the illustrated exemplary embodiment, the floor panel 10 is substantially rectangular in shape and has a length LT of about 36 inches (about 91.4 centimeters) and a width WT of about 6 inches (about 15.2 centimeters). However, it will be appreciated by those skilled in the art that the geometrical shape and the length LT and the width WT of the floor panel 10 may be varied depending on the desired dimension and geometrical configuration and the desired surface visual. For example, the floor panel 10 may alternatively have a substantially square shape.

Figure 2:
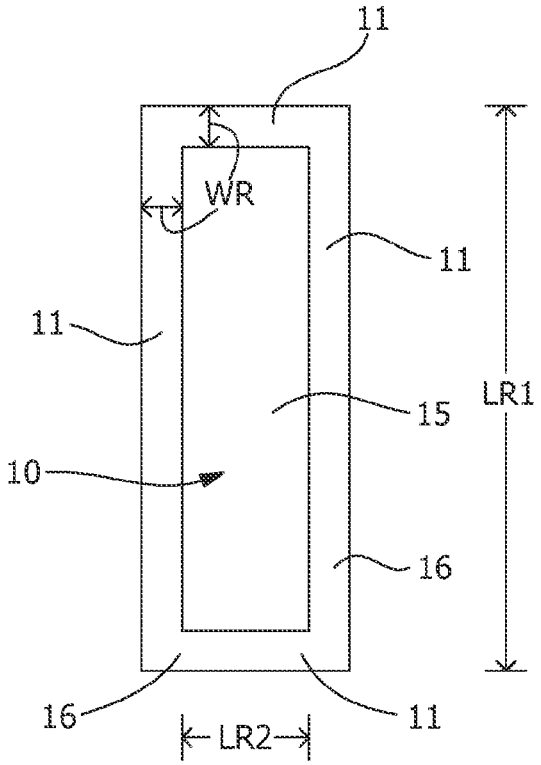
FIG. 2 is a bottom view of the exemplary floor panel of FIG. 1 with the exemplary joining members removed.
Figure 5:
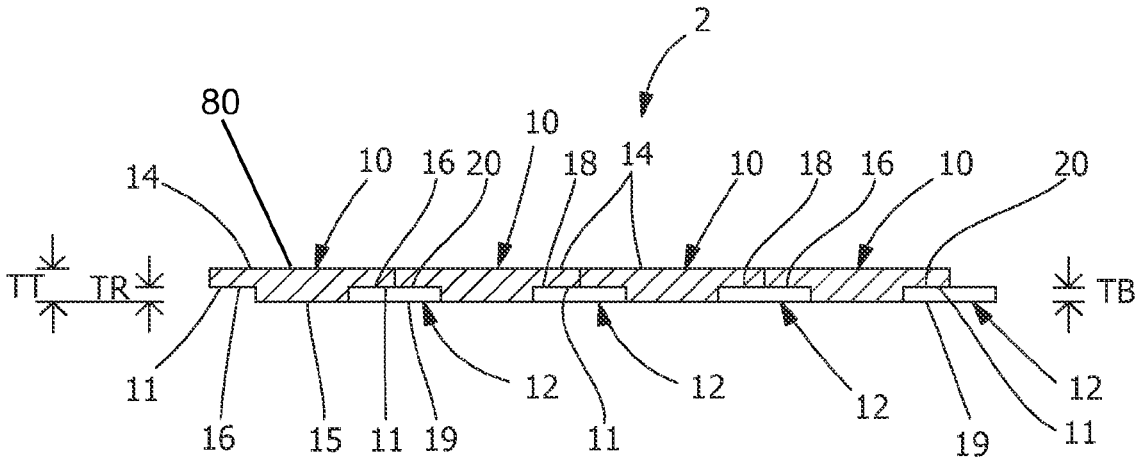
FIG. 5 is a sectional view taken along line 5-5 of FIG. 4.

As shown in FIGS. 2 and 5, the floor panel 10 has recesses 11 which extends about the periphery of the bottom surface 15. The recesses 11 may be created in the floor panel 10 by machining the back surface 15 of the floor panel 10 (for example by using a CNC-type router), by pressing the floor panel 10 is a special die during the punch out process associated with the manufacture of the floor, or by other known means. The thickness TR of the recesses 11 is substantially less than the thickness of the floor panel 10. The amount of material removed or compacted to form the recesses 11 or the thickness TR of the recesses 11 of the floor panel 10 is about 5 to 10 mils, preferably about 5 to 9 mils, and more preferably about 7 to 9 mils. A surface 16 is provided in each recess 11.

In the illustrated exemplary embodiment, the recesses 11 are substantially rectangular in shape. Recesses 11 along the long side of the floor panel 10 have a length LR1, while recesses 11 along the short side of the floor panel 10 have a length LR2. The width WR of the recesses 11 may vary depending upon the width WT of the floor panel 10. In the exemplary embodiment shown, the width WR of the recesses is about 1 inch (about 2.54 centimeters). It will be appreciated by those skilled in the art that the geometrical shape, including the length LR and the width WR of the recesses 11 of the floor panel 10 may be varied. For example, the width WR of the recesses may be less than 1 inch or more than 1 inch, including, but not limited to, about 1½ inches, about 2 inches, or wider or any measurement inbetween.

Figure 6:
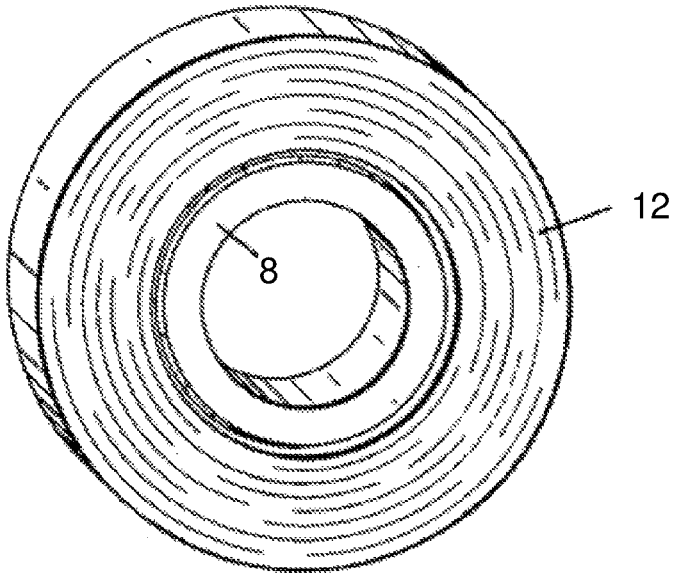
FIG. 6 is perspective view of the joining member being a film or tape and being in roll form.

As shown in FIGS. 1 and 5, the joining member 12 is positioned in respective recess 11. Each joining member 12 has a top surface 18 and a bottom surface 19. As shown in FIG. 6, the joining member 12 may be formed, for example, from a film or tape comprising plastic, vinyl, polyvinyl chloride, polyester, polyolefin, nylon, or combinations thereof. The joining member 12 may also include recycle material, such as post industrial or post consumer scrap. A film, tape, spline or strip may be rigidly or flexibly applied to the joining member 12 and is preferably moisture resistant or waterproof. Additionally, the film or tape may be capable of being delivered or shipped in rolls or splines 8. In the illustrated exemplary embodiment, each joining member 12 comprises a single layer of rigid black polyvinyl chloride film. Alternatively, the joining member 12 could comprise multiple layers, such as two layers of film laminated with a mat, such as a glass mat or polyethylene terephthalate mat, there between. The joining member 12 could also be provided with at least one of a continuous or discontinuous ink layer, antimicrobial layer, sound deadening layer, cushioning layer, slide resistant layer, stiffening layer, channeling layer, mechanically embossed texture, or chemical texture.

As shown in the exemplary embodiment, the joining members 12 may be in strips which can be cut to the appropriate length to be positioned in respective recesses 11 on the long side of the floor panel 10 or on the short side of the floor panel 10. Alternatively, the joining members 12 may be cut into L-shaped members which can be inserted into one long side recesses and one short side recesses of the floor panel 10.

As shown in FIGS. 3 and 5, each joining member 12 has a thickness TB which is less than the thickness TT of the floor panel 10. The joining member 12 has a thickness TB of about 4 to 9 mils, preferably about 4 to 8 mils, and more preferably about 6 to 8 mils. The thickness TB of the joining member 12 is dimensioned to be essentially equivalent to, slightly smaller, or slightly larger than the thickness TR of the respective recess 11 into which the respective joining member 12 will be inserted. Each strip of joining member 12 is dimensioned to have a width WB which is larger than the width WR of the recesses 11 into which the joining member 12 is to be inserted.

In the illustrated exemplary embodiment, each strip of joining member 12 is substantially rectangular in shape and has the length LB1 of about 36 inches (about 91.4 centimeters) or a length LB2 of about 6 inches (about 15.2 centimeters). The width of the strips of joining member 12 is about 2 inches (3.1 centimeters). However, it will be appreciated by those skilled in the art that the geometrical shape and the length the width of the strips of joining member 12 may be varied depending on the desired dimension and geometrical configuration of the recesses 11 of the floor panel 10.

As shown in FIG. 5, surfaces 16 of the recesses 11 are laminated to the top surfaces 18 of the joining members 12 by an adhesive 20. The adhesive 20 may be, for example, any suitable adhesive, such as a hot melt adhesive, a pressure sensitive adhesive, or a structural and/or reactive adhesive. In the illustrated exemplary embodiment, the adhesive is a pressure sensitive acrylic adhesive. The adhesive 20 may have, for example, a lateral bond strength of at least 30 psi, and more preferably about 30-70 psi, and even more preferably about 50-60 psi after having been heat aged for about 24 hours at 145 degrees Fahrenheit. In the illustrated exemplary embodiment, the adhesive 20 is provided on substantially an entirety of the top surfaces 18 of the joining members 12. The adhesive 20 may be applied to have a thickness, for example, of about 1-2 mils (about 0.0254-0.0508 millimeters). It will be appreciated by those skilled in the art, however, that the thickness of the adhesive 20 may vary depending on the texture of the surface 16 of the recess 11 and the texture of the top surface 18 of the joining member 12 in that a substantially smooth surface would require less of the adhesive 20 due to better adhesion and bond strength. The total thickness of the adhesive and the joining member 12 is dimensioned to be essentially equivalent to, slightly smaller, or slightly larger than the thickness TR of the respective recess 11 into which it is positioned.

Referring to FIG. 1, the joining member 12 is adhered to the recesses of the floor panel 10 so that the joining member 12 extends beyond the floor panel 10. In other words, opposing first ends 21 of the floor panel 10 are offset in the direction of the length from opposing first ends 23 of the joining members 12 an offset distance D1 and opposing second ends 22 of the floor panel 10 are offset in the direction of the width from opposing second ends 24 of the joining members 12 an offset distance D2. The offset distances D1 and D2 are substantially the same. In the illustrated exemplary embodiment, the offset distances D1 and D2 are, for example, about 1 inch (about 2.5 centimeters). Because the adhesive 20 is provided on substantially the entirety of the top surfaces 18 of the joining members 12, due to the offset of the floor panel 10 relative to the joining members 12, a marginal end portion of the top surfaces 18 of the joining members 12 remains exposed to form an adhesive surface 25, and a marginal end portion of the surfaces 16 of the recesses 11 of the floor panel 10 remains exposed to form an attachment surface 26.

It will be appreciated by those skilled in the art that the adhesive 20 may also be provided on the surfaces 16 of the recesses 11 instead of or in addition to the top surfaces 18 of the joining members 12 depending on the type and characteristics of the adhesive 20 used to achieve optimum adhesion and bond strength when adhering the adjacent floor panels 10, as described in more detail below with reference to FIGS. 2-3. Further, the adhesive 20 used to adhere the floor panel 10 to the joining members 12 may be different from the adhesive 20 provided on the exposed surfaces 16 of the recesses 11 and and/or the exposed surfaces of the joining members 12.

As shown in FIG. 1, the release member 13 is positioned adjacent to the top surface 14 of the floor panel 10 and the adhesive surface 25 to cover the adhesive surface 25 during shipping of the floor panel 10 and prior to the installation thereof. In the illustrated exemplary embodiment, the release member 13 is a flexible sheet corresponding approximately in size and shape to the strips of joining members 12. It will be appreciated by those skilled in the art, however, that the size and shape of the release member 13 may be varied, as long as the release member 13 adequately covers the adhesive surface 25. The release member 13 may be made, for example, from any known suitable release material, such as a poly or silicone coated paper, a plastic sheet, a polymer film, or other material that enables the release member 13 to be quickly and easily removed from the adhesive surface 25 during the installation of the floor panel 10.

FIG. 5 shows the floating floor system 2 comprising a plurality of the floor panels 10. As shown in FIG. 5, in order to install the floor panels 10, at least one of the floor panels 10 is arranged on a sub-floor such that the bottom surfaces 19 of the joining members 12 and the bottom surface 15 of the floor panel 10 are in contact with the sub-floor. Preferably, the installation of the floor panels 10 should start adjacent a wall and/or in a corner of a room (not shown) and proceed outwardly there from. The release member 13 is removed from the floor panel 10 to expose the adhesive surfaces 25 on the top surfaces 18 of the joining members 12. Another one of the floor panels 10 is then adhered to the adhesive surface 25 by engaging the attachment surface 26 on the surface 16 of the recess 11 with the adhesive surface 25.

Figure 4:
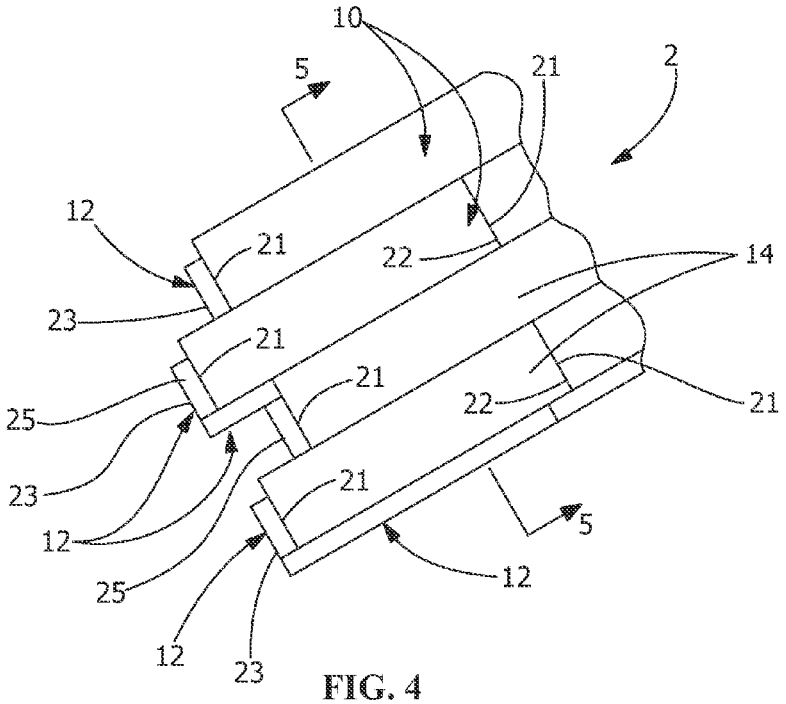
FIG. 4 is a perspective view of an exemplary floating floor system incorporating multiple exemplary floor panels of FIG. 1.

As shown in FIG. 4, the floor panels 10 are installed such that the first ends 21 of the floor panels 10 substantially abut the first ends 21 of the adjacent floor panels 10, and the second ends 22 of the floor panels 10 substantially abut the second ends 22 of the adjacent floor panels 10. In so doing, exposed surfaces 18 of the joining members 12 are positioned in respective recesses 11. The process is repeated until the desired number of the floor panels 10 covers the sub-floor. Because the joining members 12 and floor panels are yieldable to surface irregularities of the sub-floor, the floor panel 10 will conform to any surface irregularities in the sub-floor and will therefore lie substantially flat on the sub-floor. The floor panels 10 can thereby be installed on the sub-floor without any bonding material or adhesive being applied to the sub-floor. Additionally, because of the nature of the adhesive 20, particularly when the adhesive is a pressure sensitive adhesive, the floor panels 10 are capable of being easily detached from one another without damaging the floor panels 10 for ease of installation and/or replacement thereof. The peel strength of the floor panel 10 relative to the joining member 12 is preferably in the range of about 8-12 lbs/inch width, and more preferably in the range of about 9-11 lbs/inch width, and even more particularly in the range of about 9.3-10.9 lbs/inch width. It will be appreciated by those skilled in the art that the pattern of the floor panels 10 shown in FIG. 4 is just one of numerous possible patterns for installing the floor panels 10 and that the installation of the floor panels 10 is not limited thereto.

Because the thickness TB of the joining members 12 of the floor panels 10 is significantly less than the thickness TT of the floor panel 10, when the adjacent floor panels 10 are engaged, any unwanted gaps or overlapping that may occur between the first and second ends 22, 24 of the joining members 12 of the adjacent floor panels 10 due to deviations in the size of the marginal end portions and/or errors occurring during installation will not impact the aesthetic and/or structural characteristics of the floor panel 10. Also, the size of any gaps occurring between the sub-floor and the unsupported marginal end portions of the floor panel 10 of a first row of the floor panels 10 is reduced. Therefore, by reducing the thickness TB of the joining members 12, deformation at the top surface 18 of the floor panel 10 can be prevented. Additionally, because the thickness TB of the joining members 12 is smaller than the thickness TT of the floor panel 10, when the floor panels 10 are stacked, for example, during shipping, the distance between the unsupported marginal end portions of the adjacent floor panels 10 is decreased such that any bending and/or curling of the unsupported marginal end portions of the floor panels 10 is reduced.

This use of the joining members 12 reduces the overall film, adhesive and liner usage considerably over the known art. In addition, the configuration of the floor panels 10 and joining members 12 allows for easier assembly of the floor in the field and on the job site. In one exemplary embodiment, the floor panel is a smooth back vinyl, thereby allowing reducing the amount of adhesive required to complete the floor/assembly and the locking of the planks to each other. The positioning of the joining members 12 in recesses 11 has the potential to eliminate any imprint transfer to the front face of the floor panel 10, as recesses 11 around the perimeter of the floor panel 10 that allow the backing strips or joining members 12 to be attached flush with the back of the floor panel without creating a ledge.

Thus, in exemplary embodiments, the joining members and adhesive required to create the shiplap is reduced by approximately 75% over the prior art, and the release member or liner to be disposed of would be reduced by approximately 50% to 75% when compared to the prior art. In addition, the use of the narrow strips of backing is more easily assembled and much simpler to automate. As the bottom surface of the floor tile and the bottom surface of the joining members are flush when assembled, the use of the joining members does not create any imprints on the top surface of the floor panel during shipping, even with double pallet stacking, thereby allowing for more packaging options.

While the written description has referred to a preferred embodiment, it will be understood by those skilled in the art that various changes and modifications may be made and equivalents may be substituted for elements thereof without departing from the patentable scope as defined by the claims.

Therefore, it is intended that the patentable scope not be limited to the particular embodiments disclosed as the best mode contemplated, but rather other embodiments are intended to be within the scope of the claims if they have structural elements that do not differ from the literal language of the claims, or if they include equivalent structural elements with insubstantial differences from the literal language of the claims.

What is claimed is:

1. A floor panel apparatus comprising:

a floor panel comprising:

a first end, a second end, a third end, a fourth end, a top surface, a side surface extending downwardly from the top surface to define a periphery of the floor panel, and a bottom surface, the top surface having a visible decorative pattern, the bottom surface of the floor panel having a recess which extends about the periphery of the floor panel, the recess defined by a recess wall and a recess surface, wherein the recess surface extends from the side surface of the floor panel to the recess wall as a continuous planar surface, and the recess surface is parallel to the bottom surface of the floor panel;

a longitudinal axis extending from the first end of the floor panel to the second end of the floor panel;

a transverse axis extending from the third end of the floor panel to the fourth end of the floor panel; and a joining member coupled to the floor panel by an adhesive positioned between the recess surface of the recess and a top surface of the joining member, the adhesive adhering the top surface of the joining member to the recess surface of the recess, a bottom surface of the joining member and the bottom surface of the floor panel being essentially flush with each other, wherein the joining member protrudes longitudinally beyond the first end of the floor panel in the first longitudinal direction and protrudes transversely beyond the fourth end of the floor panel in a first transverse direction.

2. The floor panel apparatus according to claim 1 wherein the joining member is an L-shaped member.

3. The floor panel apparatus according to claim 1 further comprising a release member adhered to the portion of the joining member that protrudes longitudinally beyond the first end of the floor panel in the first longitudinal direction and transversely beyond the fourth end of the floor panel in a first transverse direction.

4. The floor panel apparatus according to claim 1 wherein the floor panel comprises one or more of a mix layer, a print film comprising the visible decorative pattern, a wear layer and a top coat.

5. The floor panel apparatus according to claim 1 wherein the recess continuously extends about the periphery of the floor panel to form a closed-geometry.

6. The floor panel apparatus according to claim 5 wherein the closed-geometry is a rectangle.

7. The floor panel apparatus according to claim 1 wherein the adhesive covers an entirety of the top surface of the joining member.

8. The floor panel apparatus according to claim 1 wherein the joining member comprises a first portion that extends substantially parallel to the longitudinal axis and second portion that extends substantially parallel to the transverse axis, the first and second portions being integrally formed as single component.

9. The floor panel apparatus according to claim 1 wherein the recess is defined by a recess wall and a recess surface, the recess wall extending from the bottom surface of the floor panel to the recess surface as a continuous planar surface, the recess surface extending from the side surface of the floor panel to the recess wall as a continuous planar surface, wherein the side surface terminates at the top surface and at the recess surface.

10. The floor panel apparatus according to claim 1 wherein the joining member is a film or a tape, and wherein the floor panel is a flexible sheet.

11. A floor panel apparatus comprising:

a floor panel comprising:

a first end, a second end, a third end, a fourth end, a top surface, a side surface extending downwardly from the top surface to define a periphery of the floor panel, and a bottom surface, the top surface having a visible decorative pattern, the bottom surface of the floor panel having a recess which extends about the periphery of the floor panel to the side surface of the floor panel as a substantially rectangular continuous planar surface;

a longitudinal axis extending from the first end of the floor panel to the second end of the floor panel;

a transverse axis extending from the third end of the floor panel to the fourth end of the floor panel; and a joining member positioned within the recess and coupled to the floor panel by an adhesive, a bottom surface of the joining member and the bottom surface of the floor panel being essentially flush with each other, the joining member comprising:

a first portion that extends substantially parallel to the longitudinal axis, the first portion: (1) protruding transversely beyond the fourth end of the floor panel in a first transverse direction; and (2) protruding longitudinally beyond the first end of the floor panel in a first longitudinal direction; and the first portion having a first end and a second end, the second end of the first portion being offset from the second end of the floor panel in the first longitudinal direction; and a second portion that extends substantially parallel to the transverse axis, the second portion protruding longitudinally beyond the first end of the floor panel in the first longitudinal direction, the second portion having a first end that is offset from the third end of the floor panel in the first transverse direction.

12. The floor panel apparatus according to claim 11 wherein the recess is defined by a recess wall and a recess surface, the recess wall extending from the bottom surface of the floor panel to the recess surface as a continuous planar surface, the recess surface extending from the side surface of the floor panel to the recess wall as a continuous planar surface, wherein the side surface terminates at the top surface and at the recess surface, the periphery comprising the first, second, third and fourth ends of the floor panel.

13. The floor panel apparatus according to claim 12 wherein the side surface of the floor panel extends from the top surface of the floor panel to the recess surface as a continuous planar surface, and wherein the periphery of the floor panel defines an outermost boundary of the floor panel.

14. The floor panel apparatus according to claim 12 wherein the adhesive adheres a top surface of the joining member to the recess surface of the recess.

15. The floor panel apparatus according to claim 11 wherein the joining member is an L-shaped member.

16. The floor panel apparatus according to claim 11 further comprising a release member adhered to the portion of the joining member that protrudes longitudinally beyond the first end of the floor panel in the first longitudinal direction and transversely beyond the fourth end of the floor panel in a first transverse direction.

17. The floor panel apparatus according to claim 11 wherein the floor panel comprises one or more of a mix layer, a print film comprising the visible decorative pattern, a wear layer and a top coat.

18. The floor panel apparatus according to claim 11 wherein the adhesive covers an entirety of the top surface of the joining member.

19. The floor panel apparatus according to claim 11 wherein the first and second portions are integrally formed as a single component.

* * * * *